US010048018B2

(12) United States Patent
Michitsuji

(10) Patent No.: US 10,048,018 B2
(45) Date of Patent: Aug. 14, 2018

(54) HEAT EXCHANGER FOR AIR CONDITIONER

(75) Inventor: Yoshiharu Michitsuji, Sakai (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 920 days.

(21) Appl. No.: 14/000,949

(22) PCT Filed: Feb. 20, 2012

(86) PCT No.: PCT/JP2012/001122

§ 371 (c)(1),
(2), (4) Date: Aug. 22, 2013

(87) PCT Pub. No.: WO2012/114719

PCT Pub. Date: Aug. 30, 2012

(65) Prior Publication Data

US 2013/0327509 A1 Dec. 12, 2013

(30) Foreign Application Priority Data

Feb. 23, 2011 (JP) ..... 2011-037129

(51) Int. Cl.
*F28F 1/00* (2006.01)
*F28F 9/02* (2006.01)
(Continued)

(52) U.S. Cl.
CPC ..... *F28F 1/12* (2013.01); *F24F 1/0003* (2013.01); *F24F 1/0059* (2013.01); *F24F 13/30* (2013.01);
(Continued)

(58) Field of Classification Search
CPC ..... F28D 7/005; F28D 7/0058; F28D 7/08; F28D 7/082; F28D 7/085; F28D 7/087;
(Continued)

(56) References Cited

U.S. PATENT DOCUMENTS 2,044,069 A * 6/1936 Erbach ..... F25B 39/02 165/137
4,446,915 A * 5/1984 Welch ..... F28D 1/0477 165/144
(Continued)

FOREIGN PATENT DOCUMENTS

EP 2031334 A1 3/2009
EP 2037186 A1 3/2009
(Continued)

OTHER PUBLICATIONS

International Search Report for PCT/JP2012/001122 dated Mar. 19, 2012.

*Primary Examiner* — Jason Thompson
(74) *Attorney, Agent, or Firm* — Birch, Stewart, Kolasch & Birch, LLP

(57) ABSTRACT

A heat exchanger has a plurality of paths as refrigerant paths, and at least one of the plurality of paths has a coexistent path, in which both of a parallel flow portion where refrigerant flows from a heat transfer tube of one of the tube rows to a heat transfer tube of a tube row which is on a downstream side of the one tube row in terms of an air flow direction, and a counter-flow portion where refrigerant flows from a heat transfer tube of one of the tube rows to a heat transfer tube of a tube row which is on an upstream side of the one tube row in terms of the air flow direction, exist in use both as a condenser and as an evaporator.

1 Claim, 11 Drawing Sheets

(51) Int. Cl.

| | |
|---|---|
| ***F28F 7/00*** | (2006.01) |
| ***F28F 9/22*** | (2006.01) |
| ***F28F 1/12*** | (2006.01) |
| ***F24F 13/30*** | (2006.01) |
| ***F24F 1/00*** | (2011.01) |
| ***F28D 1/047*** | (2006.01) |
| ***F28F 1/32*** | (2006.01) |
| ***F25B 39/00*** | (2006.01) |
| *F28D 21/00* | (2006.01) |
| *F24F 1/18* | (2011.01) |
| *F25B 13/00* | (2006.01) |

(52) U.S. Cl.
CPC ..... *F25B 39/00* (2013.01); *F28D 1/0477* (2013.01); *F28F 1/32* (2013.01); *F24F 1/18* (2013.01); *F25B 13/00* (2013.01); *F28D 2021/0068* (2013.01); *F28F 2215/04* (2013.01)

(58) Field of Classification Search
CPC ..... F28D 1/0417; F28D 1/047; F28D 1/0477; F28F 1/32; F28F 1/24
USPC ..... 165/144, 139, 172, 173
See application file for complete search history.

(56) References Cited

U.S. PATENT DOCUMENTS

| | | | | |
|---|---|---|---|---|
| 4,738,309 | A * | 4/1988 | Schilling | F28D 7/08 165/101 |
| 6,382,310 | B1 * | 5/2002 | Smith | F28D 15/0233 165/104.26 |
| 2004/0118151 | A1 * | 6/2004 | Hebert | F25B 39/02 62/524 |
| 2005/0247077 | A1 * | 11/2005 | Hermes | F25B 39/02 62/515 |

FOREIGN PATENT DOCUMENTS

| | | | |
|---|---|---|---|
| JP | 63-231123 | A | 9/1988 |
| JP | 2007-192442 | A | 8/2007 |
| JP | 2007192442 | A * | 8/2007 |
| JP | 2010-78287 | A | 4/2010 |

* cited by examiner

HEAT EXCHANGER FOR AIR CONDITIONER

TECHNICAL FIELD

The present invention relates to a heat exchanger which is used in an air conditioner.

BACKGROUND ART

Conventionally, a cross-fin type of heat exchanger is known as a heat exchanger which is used in an air conditioner. This heat exchanger is provided with a plurality of fins which are arranged at prescribed intervals apart, and a plurality of heat transfer tubes which pass through these fins. Air which is sucked into a case of the air conditioner exchanges heat with a refrigerant which flows inside the heat transfer tubes, when the air passes through the gaps between the fins of the heat exchanger. Consequently, the temperature of the air is adjusted. A normal heat exchanger has a row structure in which heat transfer tubes are provided in a plurality of rows along the air flow direction (See, for example, Patent Document 1).

Normally, in an air conditioner, if various paths are formed in such a manner that the flow of refrigerant and the flow of air are orthogonal counter-flows in the heat exchanger (for example, where the refrigerant and air flow in a relationship such as that shown in FIG. 11B), the heat exchange efficiency is higher than in the case of orthogonal parallel flows (for example, where the refrigerant and air flow in a relationship such as that shown in FIG. 11A). More specifically, with orthogonal counter-flows, the flow direction A of the air and the flow direction of the refrigerant in the heat transfer tubes intersect orthogonally or in a near-orthogonal state, while the refrigerant flowing inside a heat transfer tube flows towards a heat transfer tube in a tube row that is positioned to the upstream side of that heat transfer tube, in terms of the air flow direction A. Furthermore, with orthogonal parallel flows, the flow direction A of the air and the flow direction of the refrigerant in the heat transfer tubes intersect orthogonally or in a near-orthogonal state, while the refrigerant flowing inside a heat transfer tube flows towards a heat transfer tube in a tube row that is positioned to the downstream side of that heat transfer tube, in terms of the air flow direction A.

Consequently, if cooling performance is emphasized, for example, respective paths are formed in such a manner that the flow of refrigerant and the flow of air are orthogonal counter-flows in the heat exchanger during a cooling operation. However, in general, in order to improve the APF (Annual Performance Factor), the heating performance is often emphasized, and therefore, in this case, respective paths are formed in such a manner that the flow of refrigerant and the flow of air are orthogonal counter-flows in the heat exchanger during a heating operation.

However, if either the heating performance or the cooling performance is emphasized, then it may become impossible to achieve the other performance sufficiently.

Patent Document 1: Japanese Patent Application Publication No. 2010-78287

SUMMARY OF THE INVENTION

It is an object of the present invention to provide a heat exchanger for an air conditioner whereby a balance of heating performance and cooling performance can be improved.

The heat exchanger for an air conditioner according to the present invention is a cross-fin tube heat exchanger for an air conditioner capable of switching between heating operation and cooling operation, the heat exchanger including: a plurality of fins (13); and a plurality of heat transfer tubes (15) passing through the plurality of fins (13); wherein the heat exchanger has a row structure in which three or more rows of tube rows (L) of heat transfer tubes (15) are arranged along an air flow direction (A); the heat exchanger has a plurality of paths (P) which are refrigerant paths; and at least one of the plurality of paths (P) is a coexistent path (P), in which both of a parallel flow portion (R1) where refrigerant flows from a heat transfer tube (15) of one of the tube rows (L) in the row structure to a heat transfer tube (15) of a tube row (L) on a downstream side of the one tube row (L) in terms of the air flow direction (A), and a counter-flow portion (R2) where refrigerant flows from a heat transfer tube (15) of one of the tube rows (L) in the row structure to a heat transfer tube (15) of a tube row (L) on an upstream side of the one tube row (L) in terms of the air flow direction (A), exist in use both as a condenser and as an evaporator.

BRIEF DESCRIPTION OF THE DRAWINGS

FIGS. 4A and 4B are left side diagrams showing the heat exchanger for an air conditioner, wherein FIG. 4A shows a path along which refrigerant flows when the heat exchanger is used as an evaporator, and FIG. 4B shows a path along which refrigerant flows when the heat exchanger is used as a condenser.

FIGS. 7A and 7B are left side diagrams showing a first modification example of the heat exchanger for an air conditioner, wherein FIG. 7A shows a path along which refrigerant flows when the heat exchanger is used as an evaporator, and FIG. 7B shows a path along which refrigerant flows when the heat exchanger is used as a condenser.

FIGS. 11A and 11B are left side diagrams showing a conventional heat exchanger for an air conditioner, wherein FIG. 11A shows a path along which refrigerant flows when the heat exchanger is used as an evaporator, and FIG. 11B shows a path along which refrigerant flows when the heat exchanger is used as a condenser.

DESCRIPTION OF EMBODIMENTS

Below, a heat exchanger for an air conditioner 11 and an air conditioner 81 equipped with same relating to one embodiment of the present invention will be described with reference to the drawings.

<Structure of Air Conditioner>

Figure 1:
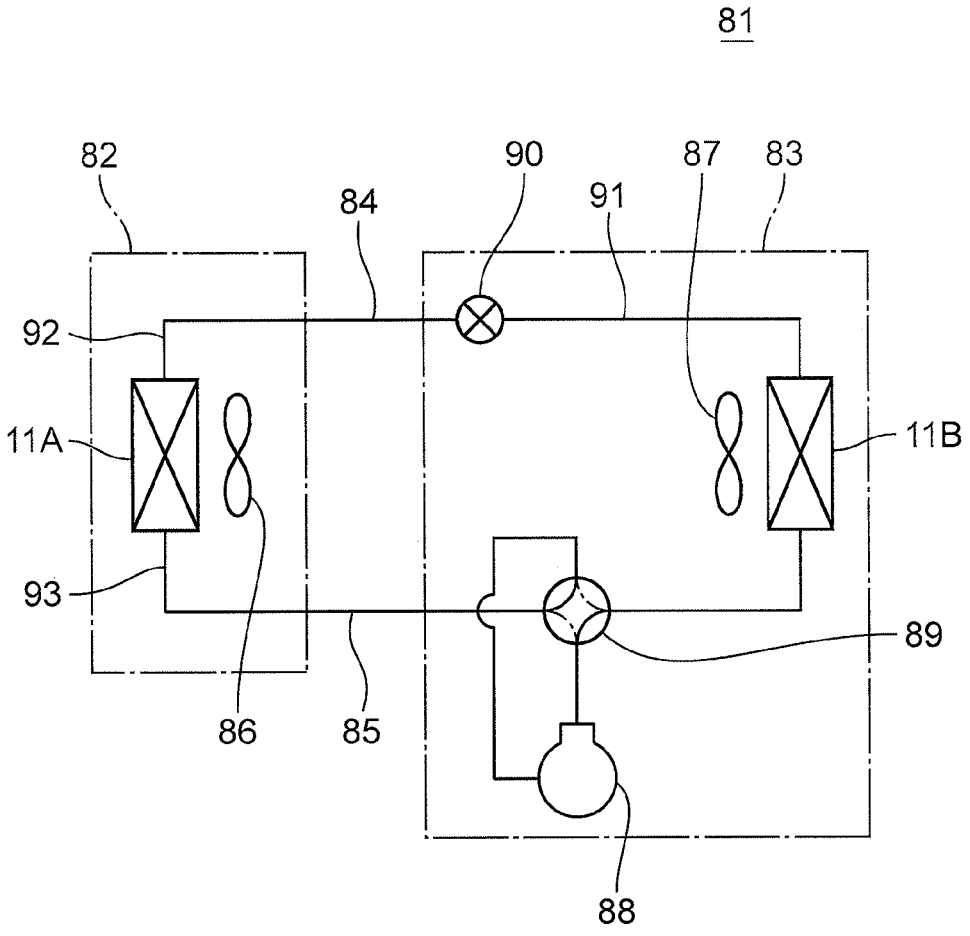
FIG. 1 is a schematic drawing showing an air conditioner equipped with a heat exchanger for an air conditioner relating to one embodiment of the present invention.

As shown in FIG. 1, the air conditioner 81 includes an indoor unit 82 and an outdoor unit 83. The indoor unit 82 includes an indoor heat exchanger 11A and an indoor fan 86. The outdoor unit 83 includes an outdoor heat exchanger 11B, an outdoor fan 87, a compressor 88, a four-way switching valve 89, and an expansion valve 90. The indoor unit 82 and the outdoor unit 83 are mutually connected by a gas side connecting pipe 84 and a liquid side connecting pipe 85, whereby a refrigerant circuit 91 is composed.

In this air conditioner 81, it is possible to switch between a cooling operation and a heating operation by switching the path of the four-way switching valve 89. In the case of the path of the four-way switching valve 89 indicated by the solid line in FIG. 1, the air conditioner 81 is performing a cooling operation. In the case of the path of the four-way switching valve 89 indicated by the dotted line in FIG. 1, the air conditioner 81 is performing a heating operation.

The indoor heat exchanger 11A performs heat exchange between the refrigerant circulating in the refrigerant circuit 91 and indoor air which is supplied by the indoor fan 86. The outdoor heat exchanger 11B performs heat exchange between the refrigerant circulating in the refrigerant circuit 91 and outdoor air which is supplied by the outdoor fan 87.

<Structure of Heat Exchanger>

The present embodiment is described with reference to a case where the heat exchanger 11 for an air conditioner is used as the indoor heat exchanger 11A and the outdoor heat exchanger 11B, but it is also possible to employ the heat exchanger 11 for either one of the indoor heat exchanger 11A and the outdoor heat exchanger 11B only. The description given below relates principally to the indoor heat exchanger 11A, and since the outdoor heat exchanger 11B has a similar structure to the indoor heat exchanger 11A, detailed description thereof is not given here.

Figure 2:
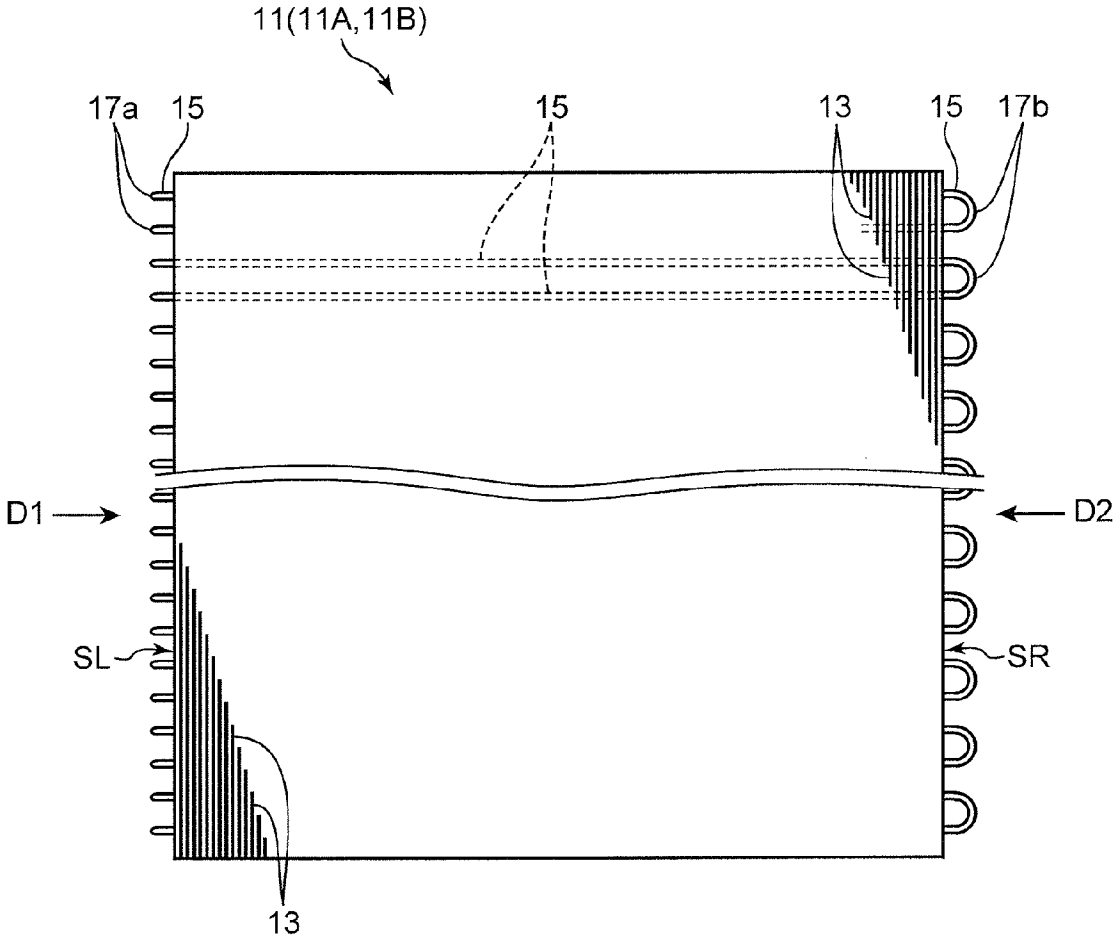
FIG. 2 is a front view diagram showing the heat exchanger for an air conditioner.

As shown in FIG. 2, the indoor heat exchanger 11A is a fin and tube type of heat exchanger. The indoor heat exchanger 11A includes a plurality of metal thin plate-shaped fins 13, and a plurality of metal heat transfer tubes 15. The respective heat transfer tubes 15 are passed through through holes (not illustrated) which are formed in each fin 13, and are supported by the plurality of fins 13 in a state of contact with the fins 13. The plurality of fins 13 are arranged in the thickness direction of the fins so as to be separated from each other by a prescribed interval. The fins 13 are arranged in a substantially parallel attitude with respect to the air flow direction A. The heat transfer tubes 15 are arranged in an attitude such that the lengthwise direction thereof is perpendicular to the plurality of fins 13.

Figure 3A:
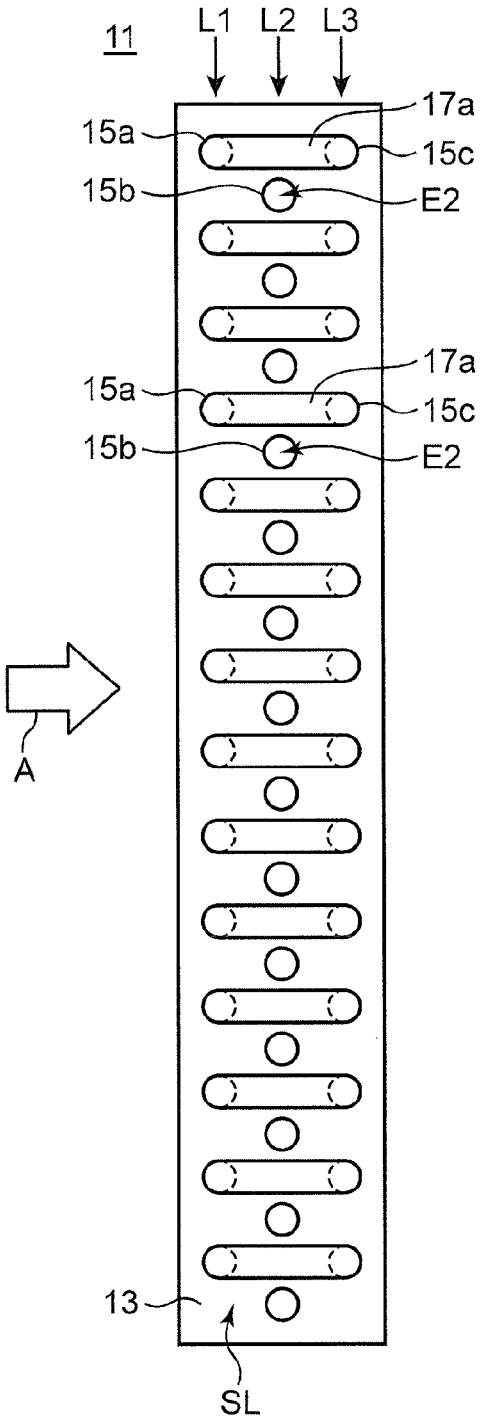
FIG. 3A is a left side diagram of the heat exchanger for an air conditioner shown in FIG. 2, as viewed from the direction D1.

In the air conditioner 81, an impeller (not illustrated) of the indoor fan 86 is driven to rotate by a motor, thereby generating a flow of air in the air flow direction A as shown in FIG. 3A. The air flow direction A is a direction along the surface of the fins 13, which intersects with the lengthwise direction of each of the heat transfer tubes 15. In the present embodiment, the air flow direction A is a substantially horizontal direction.

The heat exchanger 11A has a row structure in which three rows L of the heat transfer tubes 15 are arranged in the air flow direction A. The tube rows L of the heat transfer tubes 15 are rows which are formed by arranging a plurality of heat transfer tubes 15 in a direction intersecting with the air flow direction A (in the present embodiment, the up/down direction). This row structure includes an upstream tube row L1 which is positioned on the furthest upstream side of the air flow direction A, a downstream tube row L3 which is positioned on the furthest downstream side of the air flow direction A, and an intermediate tube row L2 which is positioned between the upstream tube row L1 and the downstream tube row L3. The heat transfer tubes 15 which constitute the tube rows L are composed by the same number of tubes (in the present embodiment, fourteen tubes). In the present embodiment, the intermediate tube row L2 is arranged at a position displaced so as to be situated lower than the upstream tube row L1 and the downstream tube row L3. But a position of the intermediate tube row L2 is not limited to the above mentioned position. The three tube rows L1 to L3 are arranged in a direction along the air flow direction A.

(Structure of Paths)

Figure 3B:
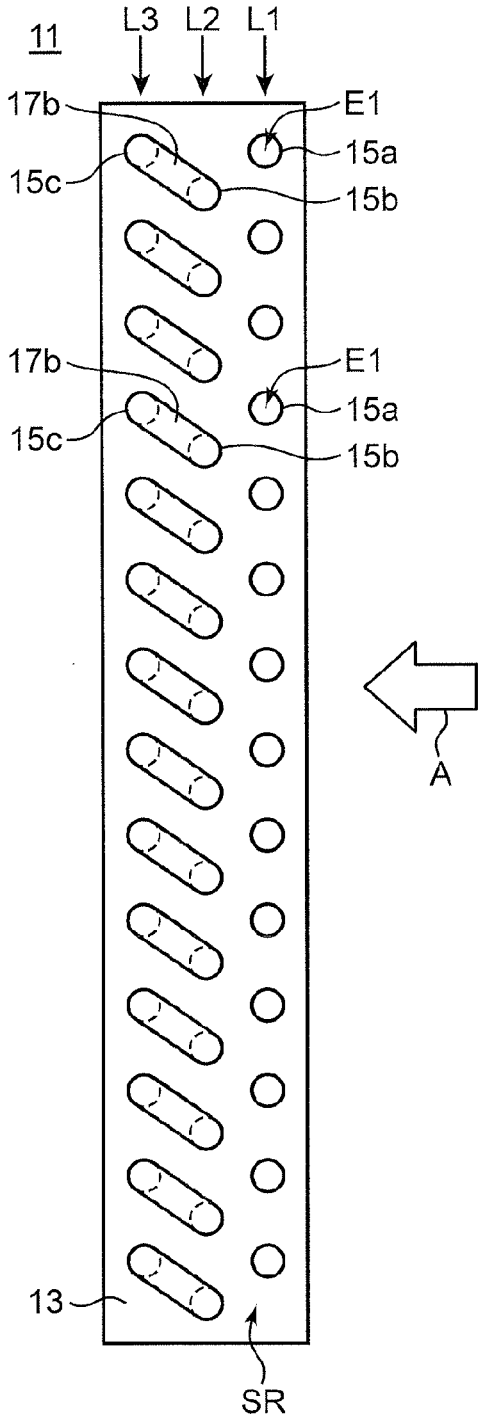
FIG. 3B is a right side diagram of the heat exchanger for an air conditioner shown in FIG. 2, as viewed from the direction D2.

The heat exchanger 11A has a plurality of paths P which are paths of the refrigerant. In the present embodiment, the plurality of paths P includes fourteen paths P1 to P14 (see FIGS. 4A and 4B). These paths P1 to P14 are arranged sequentially in the downward direction. The paths P each include three heat transfer tubes 15 and two U-shaped tube parts 17. For example, as shown in FIG. 3A and FIG. 3B, the path P1 which is in an uppermost position includes a heat transfer tube 15*a* which is positioned in an uppermost portion of the upstream tube row L1, a heat transfer tube 15*b* which is positioned in an uppermost portion of the intermediate tube row L2, a heat transfer tube 15*c* which is positioned in an uppermost portion of the downstream tube row L3, a U-shaped tube part 17*a* and a U-shaped tube part 17*b*. The U-shaped tube part 17*a* connects the heat transfer tube 15*a* of the upstream tube row L1 and the heat transfer tube 15*c* of the downstream tube row L3, in a left side section SL of the heat exchanger 11A. The U-shaped tube part 17*b* connects the heat transfer tube 15*b* of the intermediate tube row L2 and the heat transfer tube 15*c* of the downstream tube row L3, in a right side section SR of the heat exchanger 11A. In the present embodiment, the paths P2 to P14 each have the same structure as the path P1.

Each path P has a pair of end portions which form a refrigerant outlet and inlet. For example, in the path P1, a first end portion E1 and a second end portion E2 form a refrigerant outlet and inlet. The first end portion E1 is an end portion on the side of the right side section SR in the heat transfer tube 15*a* which is positioned in the uppermost portion of the upstream tube row L1. The second end portion E2 is an end portion on the side of the left side section SL in the heat transfer tube 15*b* which is positioned in the uppermost portion of the intermediate tube row L2. In the present embodiment, the paths P2 to P14 also have a first end portion E1 and a second end portion E2 at similar positions to the path P1.

Consequently, there are fourteen first end portions E1 in the right side section SR of the heat exchanger 11A and there are fourteen second end portions E2 in the left side section SL. A header (not illustrated) having branching pipes which are connected to the respective first end portions E1 is arranged in a vicinity of the right side section SR of the heat exchanger 11A and the header is connected to a liquid pipe 92. A header (not illustrated) having branching pipes which are connected to the respective second end portions E2 of the paths is arranged in a vicinity of the left side section SL of the heat exchanger 11A and this header is connected to a gas pipe 93.

(Flow of Refrigerant)

Next, the flow of refrigerant during a cooling operation and the flow of refrigerant during a heating operation will be described. Firstly, the flow of refrigerant during a cooling operation is described. During a cooling operation of the air conditioner 81, the four-way switching valve 89 in FIG. 1 is switched to the path shown by the solid line. In this cooling operation, the indoor heat exchanger 11A functions as an evaporator, and the outdoor heat exchanger 11B functions as a condenser.

During a cooling operation, the refrigerant flows into the indoor heat exchanger 11A from the liquid pipe 92, exchanges heat with the air in the indoor heat exchanger 11A, and then flows out to the gas pipe 93. More specifically, the refrigerant flows into the header via the liquid pipe 92, and is branched to the plurality of paths P1 to P14 via the plurality of branching pipes of the header. The refrigerant which has flowed into the paths P from the first end portions E1 of each path P flows inside the path P and then flows out to the corresponding branching pipe from the second end portion E2. The refrigerant which flows inside the respective branching pipes converges in the header and flows out from the header to the gas pipe 93.

Figure 4A:
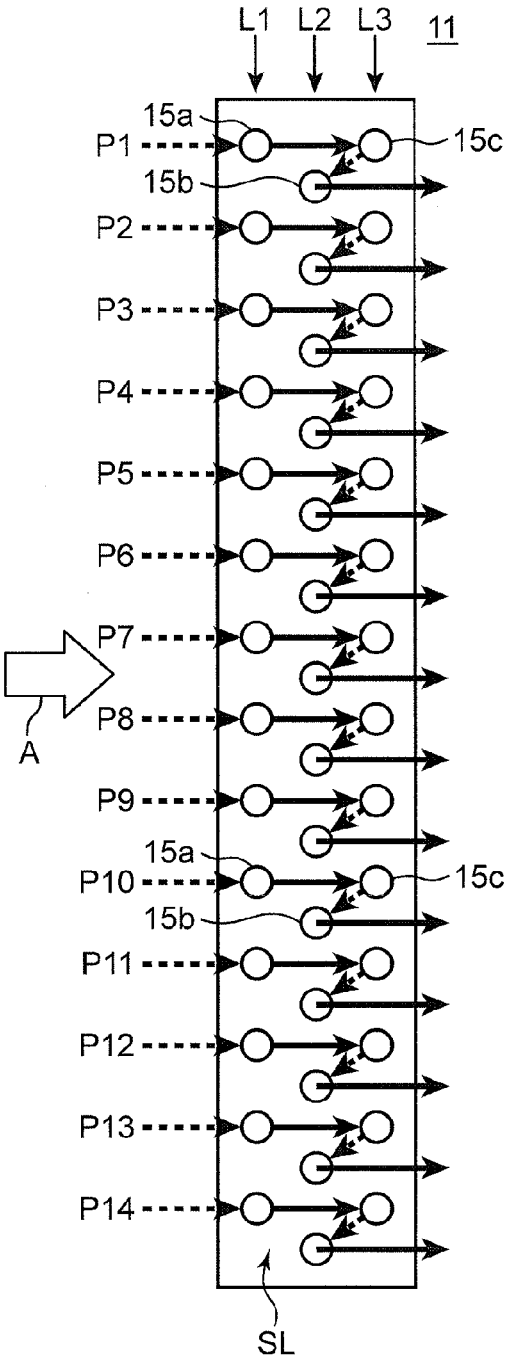

The flow of the refrigerant in the respective paths P is shown in FIG. 4A. FIG. 4A shows the left side section SL of the heat exchanger 11A. In FIG. 4A, the U-shaped tube parts 17*a* are not depicted. The solid line arrows of the respective paths P indicate the flow direction of the refrigerant in the U-shaped tube parts 17*a* which are positioned on the side of the left side section SL, and the flow of refrigerant which flows out from the second end portions E2 which are positioned on the side of the left side section SL. Furthermore, the dotted arrows in the respective paths P indicate the flow of refrigerant flowing into the first end portions E1 which are positioned on the side of the right side section SR, and the flow of refrigerant in the U-shaped tube parts 17*b* which are positioned on the side of the right side section SR of the heat exchanger 11A.

More specifically, the refrigerant flows into the heat transfer tubes 15*a* of the upstream tube row L1 from the first end portions E1 (end portions of the heat transfer tubes 15*a*) of the paths P which are positioned on the side of the right side section SR, and flows inside the heat transfer tubes 15*a* towards the left side section SL. The refrigerant which has arrived at the end portions of the heat transfer tubes 15*a* on the side of the left side section SL flows into the heat transfer tubes 15*c* of the downstream tube row L3 via the U-shaped tube parts 17*a* positioned on the side of the left side section SL, and flows inside these heat transfer tubes 15*c* towards the right side section SR. The refrigerant which has arrived at the end portions on the heat transfer tubes 15*c* on the side of the right side section SR flows into the heat transfer tubes 15*b* of the intermediate tube row L2, via the U-shaped tube parts 17*b* which are positioned on the side of the right side section SR, flows inside the heat transfer tubes 15*b* towards the left side section SL, and flows out into the branching pipes from the second end portions E2 (the end portions of the heat transfer tubes 15*b*) which are positioned on the side of the left side section SL.

Figure 11A:
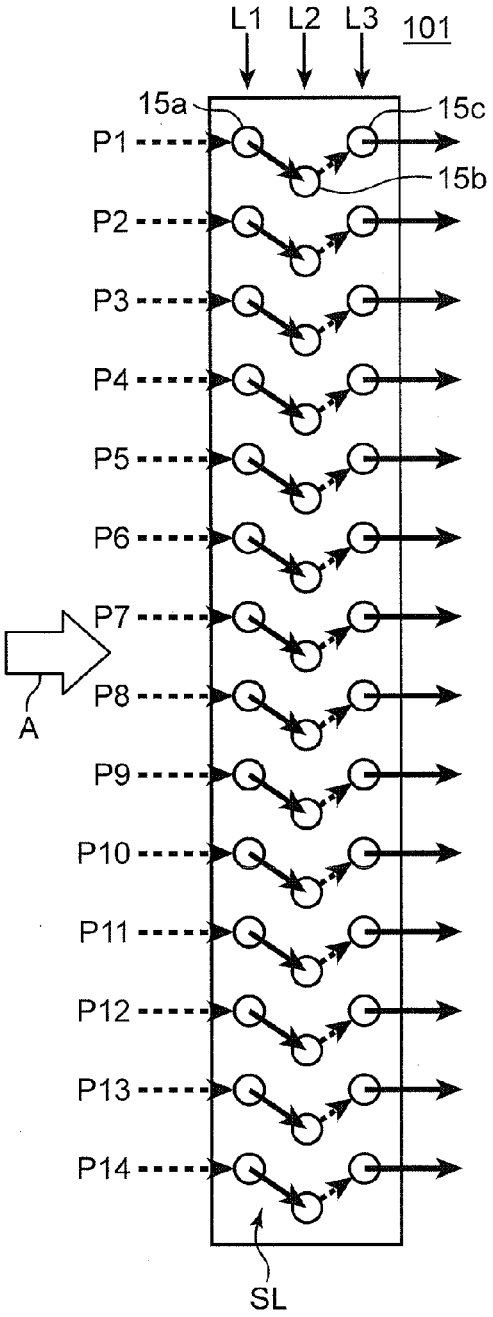

In this way, the respective paths P in the heat exchanger 11A are intermediate outflow paths in which the refrigerant flows out from the heat transfer tubes 15*b* of the intermediate tube row L2 when the heat exchanger 11A is being used as an evaporator. On the other hand, the respective paths P of a conventional heat exchanger 101 as shown in FIG. 11A are downstream outflow paths in which the refrigerant flows out from the heat transfer tubes 15*c* of the downstream tube row L3 when the heat exchanger 101 is being used as an evaporator.

Next, the flow of refrigerant during a heating operation will be described. During a heating operation of the air conditioner 81, the four-way switching valve 89 in FIG. 1 is switched to the path shown by the dotted line. In this heating operation, the indoor heat exchanger 11A functions as a condenser, and the outdoor heat exchanger 11B functions as an evaporator.

During a heating operation, the refrigerant flows into the indoor heat exchanger 11A from the gas pipe 93, exchanges heat with the air in the indoor heat exchanger 11A, and then flows out to the liquid pipe 92. More specifically, the refrigerant flows into the header via the gas pipe 93, and is branched to the plurality of paths P1 to P14 via the plurality of branching pipes of the header. The refrigerant which has flowed into the paths P from the second end portions E2 of each path P flows inside the path P and then flows out to the corresponding branching pipe from the first end portion E1. The refrigerant which flows inside the respective branching pipes converges in the header and flows out from the header to the liquid pipe 92.

Figure 4B:
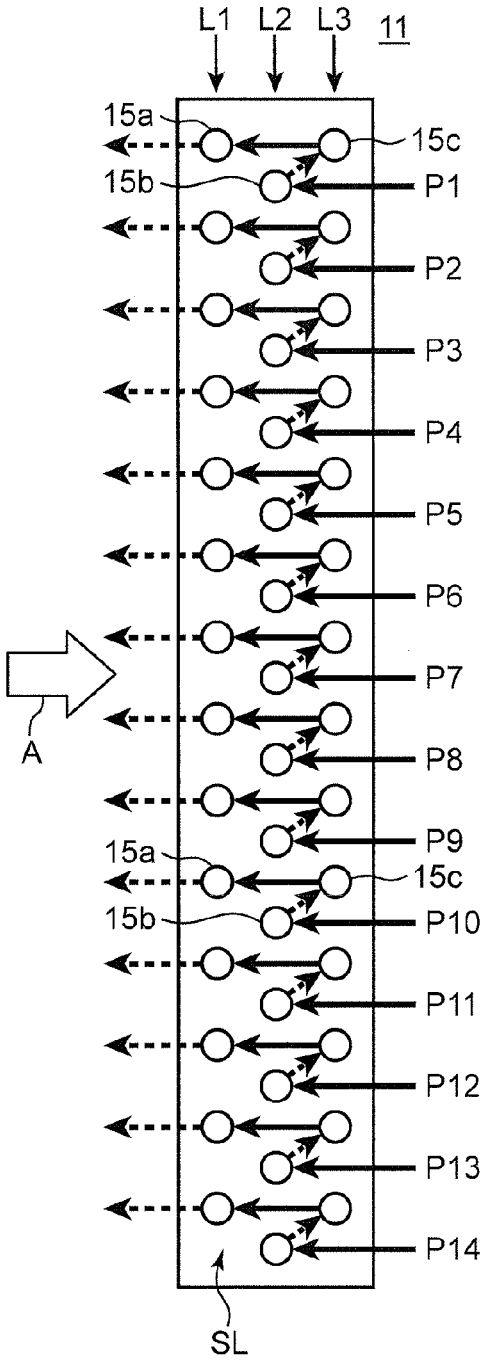

The flow of the refrigerant in the respective paths P is shown in FIG. 4B. FIG. 4B shows the left side section SL of the heat exchanger 11A. In FIG. 4B, the U-shaped tube part 17*a* is not depicted. The solid line arrows of the respective paths P indicate the flow of refrigerant which flows into the second end portions E2 which are positioned on the side of the left side section SL, and the flow direction of the refrigerant in the U-shaped tube parts 17*a* which are positioned on the side of the left side section SL. Furthermore, the dotted line arrows of the respective paths P indicate the flow direction of the refrigerant in the U-shaped tube parts 17*b* which are positioned on the side of the right side section SR of the heat exchanger 11A, and the flow of refrigerant which flows out from the first end portions E1 positioned on the side of the right side section SR.

More specifically, the refrigerant flows into the heat transfer tubes 15*b* of the intermediate tube row L2 from the second end portions E2 (the end portions of the heat transfer tubes 15*b*) of the paths P which are positioned on the side of the left side section SL, and flows inside the heat transfer tubes 15*b* towards the right side section SR. The refrigerant which has arrived at the end portions of the heat transfer tubes 15*b* on the side of the right side section SR flows into the heat transfer tubes 15*c* of the downstream tube row L3 via the U-shaped tube parts 17*b* positioned on the side of the right side section SR, and flows inside these heat transfer tubes 15*c* towards the left side section SL. The refrigerant arriving at the end portions of the heat transfer tubes 15*c* flows into the heat transfer tubes 15*a* of the upstream tube row L1 via the U-shaped tube parts 17*a* which are positioned on the side of the left side section SL, flows inside the heat transfer tubes 15*a* towards the right side section SR, and flows out to the branching pipes from the first end portions E1 (the end portions of the heat transfer tubes 15*a*) which are positioned on the side of the right side section SR.

Figure 5A:
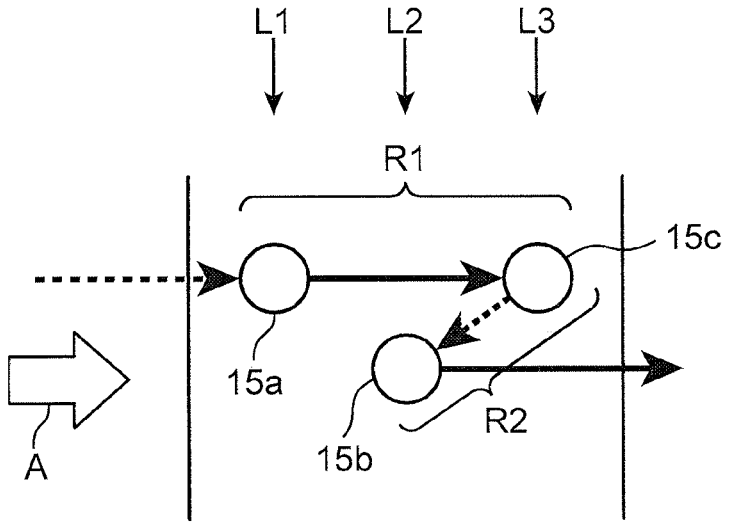
FIG. 5A is a side view diagram showing an enlarged view of one of the plurality of paths in the heat exchanger for an air conditioner shown in FIG. 4A.
Figure 5B:
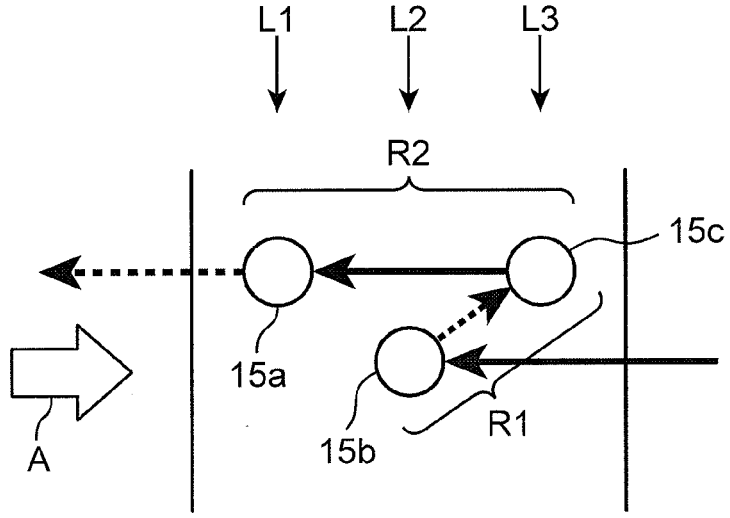
FIG. 5B is a side view diagram showing an enlarged view of one of the plurality of paths in the heat exchanger for an air conditioner shown in FIG. 4B.

FIG. 5A is a side view diagram showing an enlarged view of one of the plurality of paths P in the heat exchanger 11A shown in FIG. 4A. FIG. 5B is a side view diagram showing an enlarged view of one of the plurality of paths P in the heat exchanger 11A shown in FIG. 4B. As shown in FIG. 5A and FIG. 5B, each path P in the heat exchanger 11A is a coexistent path P in which both a parallel flow portion R1 and a counter-flow portion R2 exist both when the heat exchanger 11A is used as an evaporator (during a cooling operation) and when the heat exchanger 11A is used as a condenser (during a heating operation). In the parallel flow portion R1, refrigerant flows from a heat transfer tube 15 of one of the tube rows L to a heat transfer tube 15 of a tube row L to the downstream side of the one tube row L in terms of the air flow direction A. In the counter-flow portion R2, refrigerant flows from a heat transfer tube 15 of one of the tube rows L to a heat transfer tube 15 of a tube row L to the upstream side of the one tube row L in terms of the air flow direction A.

More specifically, in the parallel flow portion R1 of each path P, when the heat exchanger 11A is used as an evaporator, refrigerant flows from the heat transfer tube 15*a* of the upstream tube row L1 to the heat transfer tube 15*c* of the downstream tube row L3, as shown in FIG. 5A, and when the heat exchanger 11A is used as a condenser, the refrigerant flows from the heat transfer tube 15*b* of the intermediate tube row L2 to the heat transfer tube 15*c* of the downstream tube row L3, as shown in FIG. 5B. In the counter-flow portion R2 of each path P, when the heat exchanger 11A is used as an evaporator, refrigerant flows from the heat transfer tube 15*c* of the downstream tube row L3 to the heat transfer tube 15*b* of the intermediate tube row L2, as shown in FIG. 5A, and when the heat exchanger 11A is used as a condenser, the refrigerant flows from the heat transfer tube 15*c* of the downstream tube row L3 to the heat transfer tube 15*a* of the upstream tube row L1, as shown in FIG. 5B.

Figure 6A:
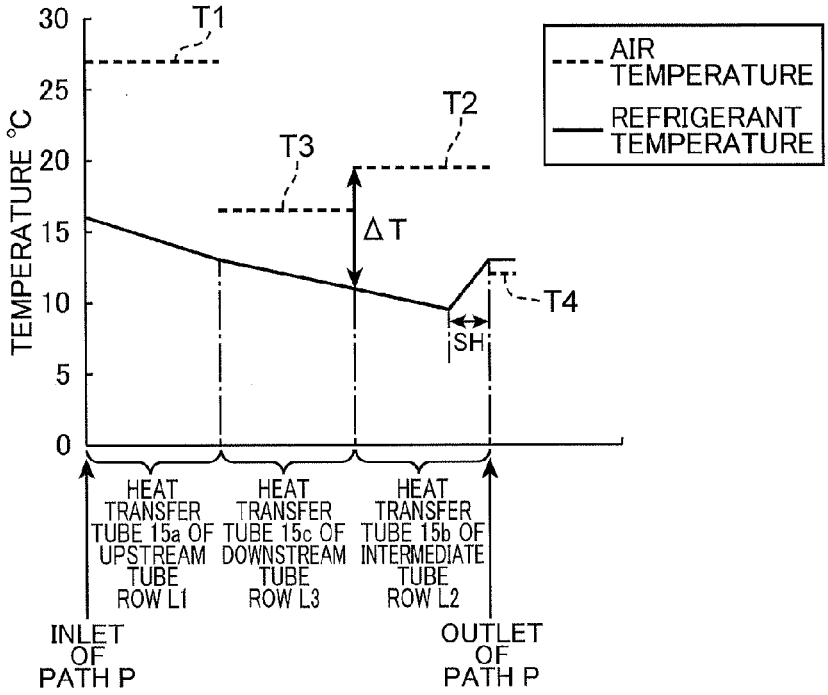
FIG. 6A is a graph showing a relationship between the air temperature and the refrigerant temperature when the heat exchanger for an air conditioner is used as an evaporator.
Figure 6B:
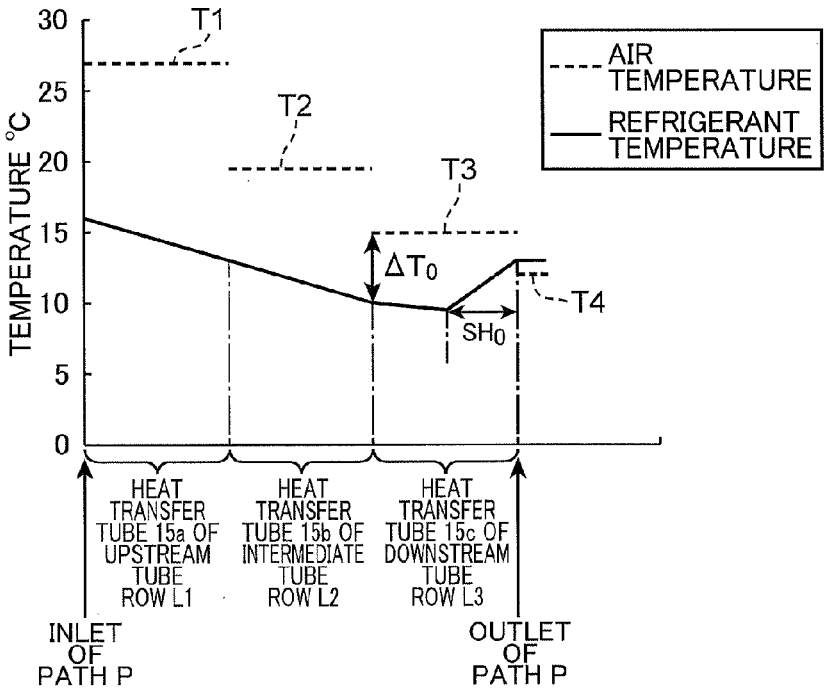
FIG. 6B is a graph showing a relationship between the air temperature and the refrigerant temperature when a conventional heat exchanger shown in FIG. 11A is used as an evaporator.

FIG. 6A is a graph showing a relationship between the air temperature and the refrigerant temperature in a case where the heat exchanger 11A is used as an evaporator. FIG. 6B is a graph showing a relationship between the air temperature and the refrigerant temperature in a case where the conventional heat exchanger 101 shown in FIG. 11A is used as an evaporator.

(Behavior of Temperature in Conventional Heat Exchanger)

Figure 11B:
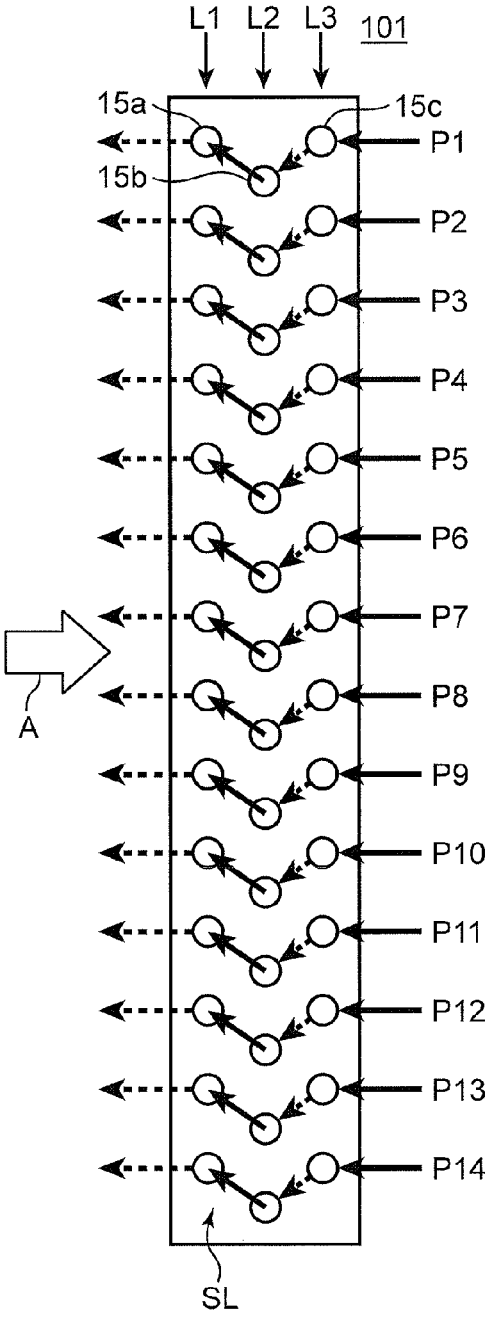

Firstly, the relationship between the air temperature and the refrigerant temperature in the conventional heat exchanger 101 shown in FIGS. 11A and 11B will be described with reference to the graph shown in FIG. 6B. In this heat exchanger 101, the heat transfer tubes 15*a* of the upstream tube row L1 (the heat transfer tubes of the first row) are connected to a liquid pipe, and the heat transfer tubes 15*c* of the downstream tube row L3 (the heat transfer tubes of the third row) are connected to a gas pipe. The heat exchanger 101 has a path structure in which all of the paths P1 to P14 form orthogonal counter-flows when the heat exchanger 101 is used as a condenser, as shown in FIG. 11B. This heat exchanger 101 is used when the heating performance is emphasized in particular. The paths P of the heat exchanger 101 are downstream outflow paths in which the refrigerant flows out from the heat transfer tubes 15*c* of the downstream tube row L3 when the heat exchanger 101 is used as an evaporator.

The paths P in the heat exchanger 101 have a path structure in which only a parallel flow portion is present when the heat exchanger 101 is used as an evaporator, as shown in FIG. 11A, and only a counter-flow portion is present when the heat exchanger 101 is used as a condenser, as shown in FIG. 11B. More specifically, in the paths P, if the heat exchanger 101 is used as an evaporator, then the refrigerant which has flowed into the heat transfer tubes 15*a* of the upstream tube row L1 flows sequentially into the heat transfer tubes 15*b* of the intermediate tube row L2 and the heat transfer tubes 15*c* of the downstream tube row L3. In other words, if the heat exchanger 101 is used as an evaporator, in each of the paths P, the end portion of the heat transfer tube 15*a* on the side of the right side section SR forms a refrigerant inlet, the refrigerant flows sequentially to the heat transfer tube 15*b* and the heat transfer tube 15*c*, and the end portion of the heat transfer tube 15*c* on the side of the left side section SL forms a refrigerant outlet. Furthermore, in each of the paths P, if the heat exchanger 101 is used as a condenser, then the refrigerant which has flowed into the heat transfer tube 15*c* of the downstream tube row L3 flows sequentially into the heat transfer tube 15*b* of the intermediate tube row L2 and the heat transfer tube 15*a* of the upstream tube row L1.

If this heat exchanger 101 is used as an evaporator, then the air temperature and the refrigerant temperature display the behavior shown in FIG. 6B in the course of the air flowing inside the heat exchanger 101 in the air flow direction A. The behavior of the respective temperatures shown in this graph is described below.

The vertical axis of the graph shown in FIG. 6B indicates the temperature and the horizontal axis indicates the path of refrigerant in a path P constituted by three heat transfer tubes 15. The left end of the horizontal axis (the point of origin of the graph) corresponds to the "inlet of the path P", which is the end portion of the heat transfer tube 15*a* on the side of the right side section SR, in the case of the heat exchanger 101 shown in FIG. 11A. The "outlet of the path P" in the horizontal axis is the end portion of the heat transfer tube 15*c* on the side of the left side section SL. More specifically, the horizontal axis indicates a path in which refrigerant flows from the "inlet of the path P" which is the point of origin of the graph, and along the path P successively via the "heat transfer tube 15*a* of the upstream tube row L1", the "heat transfer tube 15*b* of the intermediate tube row L2" and the "heat transfer tube 15*c* of the downstream tube row L3", and reaches the "outlet of the path P".

In the graph shown in FIG. 6B, the behavior of the temperature of the refrigerant (the average value of the temperature of the refrigerant in the paths P1 to P14) from the inlet of the path P to the outlet of the path P is indicated by a solid line.

Furthermore, in the graph shown in FIG. 6B, the four dotted lines indicate, sequentially from the left, the air temperature T1, the air temperature T2, the air temperature T3 and the air temperature T4. The air temperature T1 is the average temperature of the air flowing into the region of the upstream tube row L1 (first row inlet temperature). The air temperature T2 is the average temperature of the air flowing into the region of the intermediate tube row L2 (second row inlet temperature). The air temperature T3 is the average temperature of the air flowing into the region of the downstream tube row L3 (third row inlet temperature). Here, the average temperature of the air is an average value of the temperature of the air which is measured in a plurality of locations in the up/down direction, in the heat exchanger 101 which is long in the up/down direction, as shown in FIG. 11A. The air temperature T4 is the temperature of the air which has passed through the downstream tube row L3 and has reached the outlet of the heat exchanger 101 (outlet temperature).

In general, during a cooling operation by an air conditioner, the air conditioner is controlled in such a manner that the degree of superheat of the refrigerant which has exchanged heat in the indoor heat exchanger 101 becomes a prescribed value (for example, approximately 3° C.). The refrigerant is converted from wet steam into superheated steam in the region adjacent to the outlet of each path P. In other words, the refrigerant is converted from wet steam into superheated steam while flowing through the downstream side region in the heat transfer tube 15*c* of the downstream tube row L3, as shown in FIG. 6B. Consequently, in the heat exchanger 101, the temperature differential $\Delta T_0$ between the air temperature T3 which flows into the region of the downstream tube row L3 and the temperature of the refrigerant which flows in the heat transfer tubes 15*c* of the downstream tube row L3 is a factor which affects the efficiency when superheat is applied to the refrigerant.

However, in the heat exchanger 101 having the path structure shown in FIG. 11A, the air which flows into the region of the downstream tube row L3 has already exchanged heat with the heat transfer tubes 15*a* of the upstream tube row L1 and the heat transfer tubes 15*b* of the intermediate tube row L2 before reaching this region, and therefore the temperature falls to T3. Consequently, since the temperature differential $\Delta T_0$ between the air temperature T3 and the temperature of the refrigerant flowing in the heat transfer tubes 15*c* is small, then the region $SH_0$ of the heat transfer tubes 15*c* required in order to raise the degree of superheat of the refrigerant to a prescribed value becomes large. The refrigerant which has been superheated (superheated steam) has lower heat exchange efficiency with air than with wet steam, and therefore it becomes harder to achieve cooling performance, the larger the region $SH_0$. Furthermore, as the region $SH_0$ becomes larger, temperature non-uniformity of the refrigerant (fluctuations in the degree of superheat) become liable to occur and drifting of the refrigerant is liable to occur.

(Behavior of Temperature in Heat Exchanger According to the Present Embodiment)

Next, the relationship between the temperature of the air and the temperature of the refrigerant in the heat exchanger 11A according to the present embodiment shown in FIG. 4A will be described with reference to the graph shown in FIG. 6A. In the heat exchanger 11A shown in FIG. 4A, the heating performance is emphasized by connecting the heat transfer tubes 15*a* of the upstream tube row L1 (the heat transfer tubes of the first row) to the liquid pipe 92, while decline in the cooling performance is suppressed, compared to the heat exchanger 101 shown in FIGS. 11A and 11B, by connecting the heat transfer tubes 15*b* of the intermediate tube row 12 (the heat transfer tubes of the second row) to the gas pipe 93.

The paths P in the heat exchanger 11A have a path structure in which a parallel flow portion R1 and a counterflow portion R2 coexist, both when the heat exchanger 11A is used as an evaporator, as shown in FIG. 4A, and when the heat exchanger 11A is used as a condenser, as shown in FIG. 4B. More specifically, in the paths P, if the heat exchanger is used as an evaporator, then the refrigerant which has flowed into the heat transfer tubes 15*a* of the upstream tube row L1 flows sequentially into the heat transfer tubes 15*c* of the downstream tube row L3 and the heat transfer tubes 15*b* of the intermediate tube row L2. In other words, if the heat exchanger 11A is used as an evaporator, in each of the paths P, the end portion (first end portion) of the heat transfer tube 15*a* on the side of the right side section SR forms a refrigerant inlet, the refrigerant flows sequentially to the heat transfer tube 15*c* and the heat transfer tube 15*b*, and the end portion (second end portion) of the heat transfer tube 15*b* on the side of the left side section SL forms a refrigerant outlet. The respective paths P in the heat exchanger 11A are intermediate outflow paths in which the refrigerant flows out from the heat transfer tubes 15*b* of the intermediate tube row L2 when the heat exchanger 11A is being used as an evaporator.

Furthermore, in the use as a condenser, in each of the paths P then the refrigerant which has flowed into the heat transfer tube 15*b* of the intermediate tube row L2 flows sequentially into the heat transfer tube 15*c* of the downstream tube row L3 and the heat transfer tube 15*a* of the upstream tube row L1.

If this heat exchanger 11A is used as an evaporator, the air temperature and the refrigerant temperature display the behavior shown in FIG. 6A in the course of the air flowing inside the heat exchanger 11A in the air flow direction A. The behavior of the respective temperatures shown in this graph is described below.

The vertical axis of the graph shown in FIG. 6A indicates the temperature and the horizontal axis indicates the path of refrigerant in a path P constituted by three heat transfer tubes 15. The left end of the horizontal axis (the point of origin of the graph) corresponds to the "inlet of the path P", which is the end portion of the heat transfer tube 15*a* on the side of the right side section SR, in the case of the heat exchanger 11A shown in FIG. 4A. The "outlet of the path P" in the horizontal axis is the end portion of the heat transfer tube 15*b* on the side of the left side section SL. More specifically, the horizontal axis indicates a path in which refrigerant flows from the "inlet of the path P" which is the point of origin of the graph, and along the path P successively via the "heat transfer tube 15*a* of the upstream tube row L1", the "heat transfer tube 15*c* of the downstream tube row L3" and the "heat transfer tube 15*b* of the intermediate tube row L2", and reaches the "outlet of the path P".

In the graph shown in FIG. 6A, the behavior of the temperature of the refrigerant (the average value of the temperature of the refrigerant in the paths P1 to P14) from the inlet of the path P to the outlet of the path P is indicated by a solid line.

Furthermore, in the graph shown in FIG. 6A, the four dotted lines indicate, sequentially from the left, the air temperature T1, the air temperature T3, the air temperature T2 and the air temperature T4. The air temperature T1 is the average temperature of the air flowing into the region of the upstream tube row L1 (first row inlet temperature). The air temperature T2 is the average temperature of the air flowing into the region of the intermediate tube row L2 (second row inlet temperature). The air temperature T3 is the average temperature of the air flowing into the region of the downstream tube row L3 (third row inlet temperature). Here, the average temperature of the air is an average value of the temperature of the air which is measured in a plurality of locations in the up/down direction, in the heat exchanger 11A which is long in the up/down direction, as shown in FIG. 4A. The air temperature T4 is the temperature of the air which has passed through the downstream tube row L3 and has reached the outlet of the heat exchanger 11A (outlet temperature).

During a cooling operation by the air conditioner 81 equipped with the heat exchanger 11A according to the present embodiment, the air conditioner 81 is controlled in such a manner that the degree of superheat of the refrigerant which has exchanged heat in the indoor heat exchanger 11A becomes a prescribed value (for example, approximately 3° C.). In the heat exchanger 11A having the path structure shown in FIG. 4A, the refrigerant is converted from wet steam to superheated steam in a region adjacent to the outlet of each path P. In other words, the refrigerant is converted from wet steam into superheated steam while flowing through the downstream side region in the heat transfer tubes 15*b* of the intermediate tube row L2, as shown in FIG. 6A. Consequently, in the heat exchanger 11A, the temperature differential ΔT between the air temperature T2 which flows into the region of the intermediate tube row L2 and the temperature of the refrigerant which flows in the heat transfer tubes 15*b* of the intermediate tube row L2 is a factor which affects the efficiency when superheat is applied to the refrigerant.

In FIG. 6A, the lower end of the arrow indicating the magnitude of the temperature differential ΔT is located at the upstream side end portion of the heat transfer tubes 15*b* of the intermediate tube row L2, and in this case, the temperature differential ΔT expresses the differential between the air temperature T2 and the temperature of the refrigerant flowing in the upstream side end portion of the heat transfer tubes 15*b* of the intermediate tube row L2, but the invention is not limited to this. For example, the temperature differential ΔT may be the differential between the air temperature T2 and the average value of the temperature of the refrigerant flowing in the heat transfer tubes 15*b* of the intermediate tube row L2. The average value of the refrigerant temperature in this case is obtained by calculating an average of the temperature of the refrigerant flowing in the upstream side end portion of the heat transfer tubes 15*b* of the intermediate tube row L2 and the temperature of the refrigerant flowing in the downstream side end portion of the heat transfer tubes 15*b* of the intermediate tube row L2, for example.

In the heat exchanger 11A having the path structure shown in FIG. 4A, the air which flows into the region of the intermediate tube row L2 only exchanges heat with the heat transfer tubes 15*a* of the upstream tube row L1 before reaching this region, and therefore the temperature only falls to T2. Consequently, the temperature differential ΔT shown in FIG. 6A is greater than the temperature differential $\Delta T_0$ in the heat exchanger 101 (see FIG. 6B). Therefore, in the heat exchanger 11A, the region SH of the heat transfer tubes 15*b* required in order to raise the degree of superheat of the refrigerant to a prescribed value is smaller than the region $SH_0$ in the heat exchanger 101, and hence the decline in cooling performance can be suppressed in comparison with the heat exchanger 101.

Furthermore, in the heat exchanger 11A, the heat transfer tubes 15*a* of the upstream tube row L1 (the heat transfer tubes of the first row) are connected to the liquid pipe 92. Therefore, during a heating operation, (if the indoor heat exchanger 11A is being used as a condenser), then it is possible to reduce the region required in order to apply supercooling to the refrigerant (the region adjacent to the outlet of the paths P of the heat exchanger 11A). In other words, during a heating operation as shown in FIG. 4B, the refrigerant which is flowing in the heat transfer tubes 15*a* of the upstream tube row L1 is at the furthest upstream position in the air flow direction A, and therefore the refrigerant exchanges heat with air that has not yet performed heat exchange. Consequently, the temperature differential between the temperature of the refrigerant flowing in the heat transfer tubes 15*a* of the paths P and the temperature of the air becomes larger. As a result of this, the size of the downstream side region of the heat transfer tubes 15*a* which is required in order to cool the refrigerant to the prescribed degree of supercooling is smaller than when the liquid pipe 92 is connected to the heat transfer tubes 15*b* of the intermediate tube row L2 or the heat transfer tubes 15*c* of the downstream tube row L3. Consequently, in the heat exchanger 11A, it is possible to suppress decline in the cooling performance, while emphasizing the heating performance.

FIRST MODIFICATION EXAMPLE

Figure 7A:
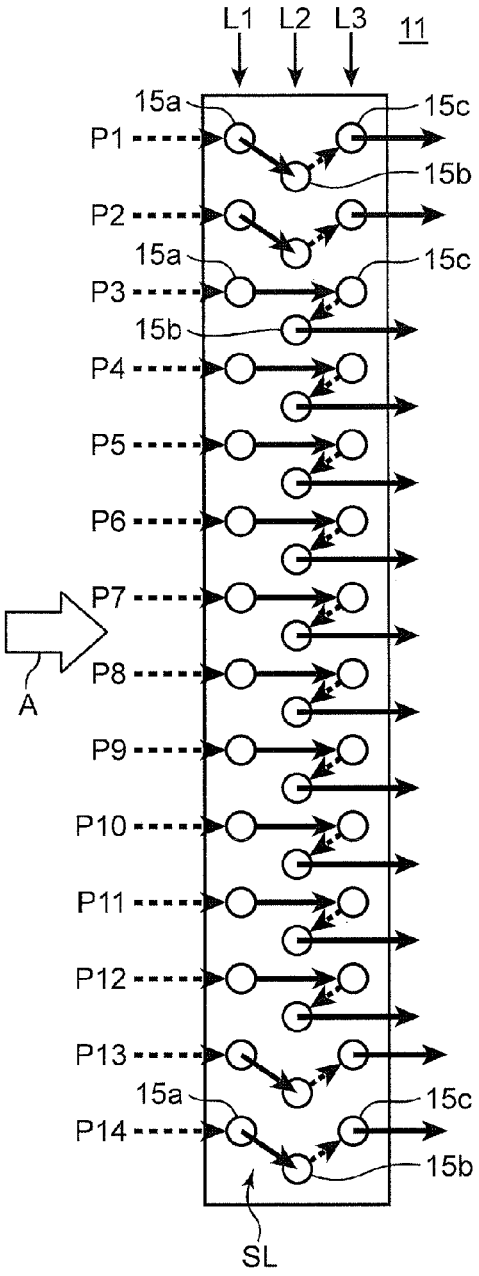
Figure 7B:
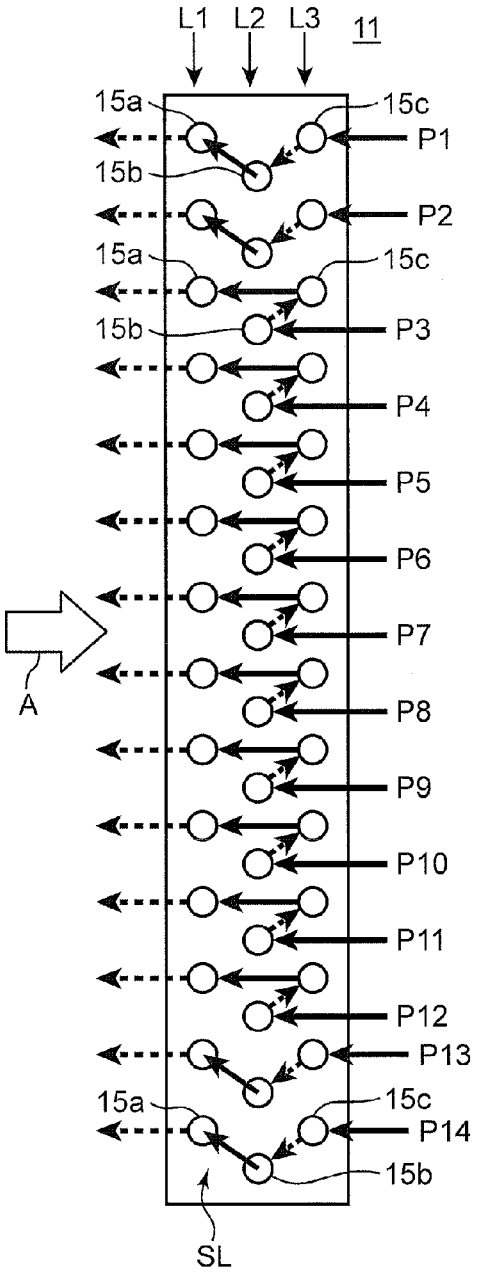

FIGS. 7A and 7B are left side diagrams showing a first modification example of a heat exchanger 11A (11). FIG. 7A shows the paths along which the refrigerant flows when the heat exchanger 11A according to the first modification example is used as an evaporator, and FIG. 7B shows the paths along which the refrigerant flows when the heat exchanger 11A according to the first modification example is used as a condenser.

In this first modification example, the plurality of paths P include a downstream outflow path in which refrigerant flows out from the heat transfer tubes 15*c* of the downstream tube row L3 and an intermediate outflow path in which refrigerant flows out from the heat transfer tubes 15*b* of the intermediate tube row L2, when the heat exchanger is used as an evaporator. The downstream outflow paths are the paths P1, P2, P13, P14, and the intermediate outflow paths are paths P3 to P12. There is a larger number of intermediate outflow paths than downstream outflow paths.

SECOND MODIFICATION EXAMPLE

Figure 8A:
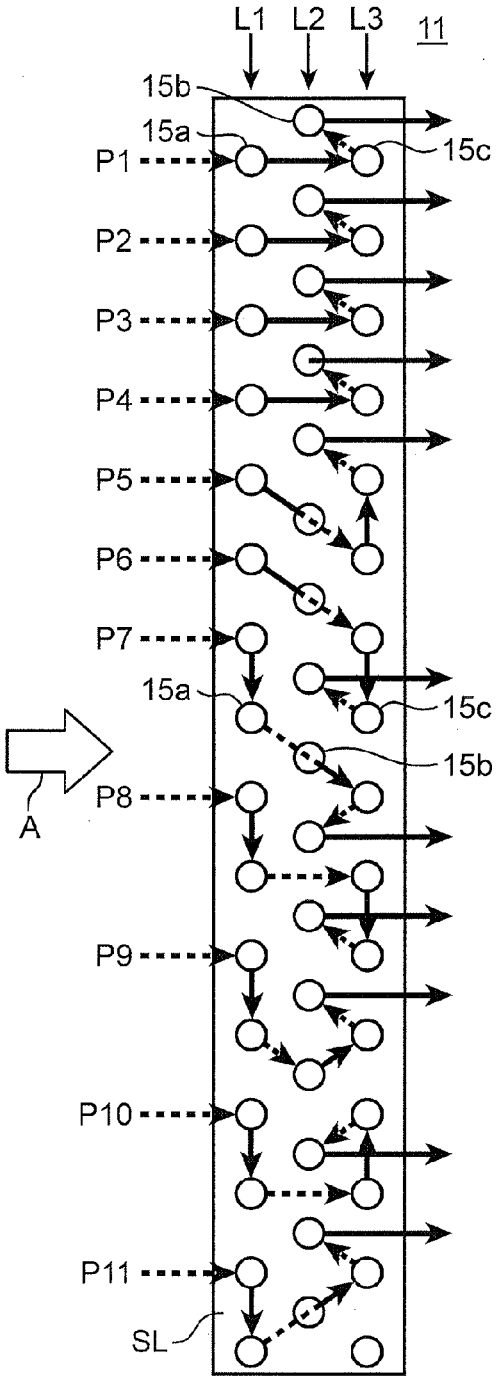
FIG. 8A is a left side diagram showing a second modification example of the heat exchanger for an air conditioner, depicting paths along which the refrigerant flows when the heat exchanger is used as an evaporator.

FIG. 8A is a left side diagram showing a second modification example of the heat exchanger 11A (11), depicting paths along which the refrigerant flows when the heat exchanger 11A is used as an evaporator.

In this second modification example, the heat exchanger 11A has eleven paths P1 to P11. The respective paths P are intermediate outflow paths in which the refrigerant flows out from the heat transfer tubes 15*b* of the intermediate tube row L2 when the heat exchanger 11A is being used as an evaporator. Furthermore, when the heat exchanger is being used as an evaporator, the refrigerant flows into the heat transfer tubes 15*a* of the upstream tube row L1 in each path P.

The paths P1 to P4 positioned in the upper portion are each constituted by three heat transfer tubes 15 and two U-shaped tube parts (1.5 round-trips). The paths P5 to P11 positioned below these paths P are each constituted by five heat transfer tubes 15 and four U-shaped tube parts (2.5 round-trips). A path structure which has different lengths of the paths P depending on the position in this way is effective in cases where the speed of the air flowing in the air flow direction A differs depending on the position in the up/down direction.

More specifically, in the second modification example shown in FIG. 8A, the speed of the air flowing in the air flow direction A is higher in the upper portion than the lower portion of the heat exchanger 11A. In other words, the speed of the air passing in the vicinity of the paths P1 to P4 is higher than the speed of the air passing in the vicinity of the paths PS to P11. The lower the speed of the air, the lower the efficiency of heat exchange between the air and the refrigerant flowing in the path P. Therefore, by forming the paths P5 to P11 which are positioned in a region where the air speed is relatively low so as to have a longer flow path length than the paths P1 to P4, it is possible to promote heat exchange between the air and the refrigerant in the paths P5 to P11.

If there is an air speed distribution such as that described above, then supposing that all of the paths P were of the same flow path length, then variation in the amount of refrigerant flowing in each of the paths P also occurs. On the other hand, in the second modification example, since the flow path lengths of the paths P are adjusted in accordance with the air speed, then it is possible to optimize the flow ratio of refrigerant flowing in each of the paths P.

THIRD MODIFICATION EXAMPLE

Figure 8B:
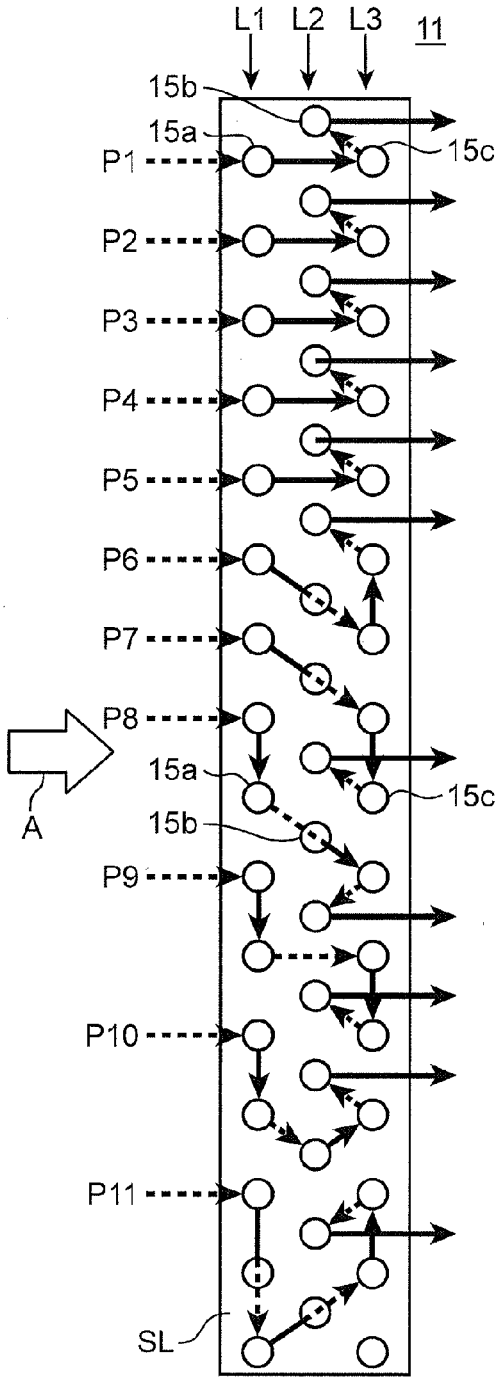
FIG. 8B is a left side diagram showing a third modification example of the heat exchanger for an air conditioner, depicting paths along which the refrigerant flows when the heat exchanger is used as an evaporator.

FIG. 8B is a left side diagram showing a third modification example of the heat exchanger 11A (11), depicting paths along which the refrigerant flows when the heat exchanger 11A is used as an evaporator.

In this third modification example, the heat exchanger 11A has eleven paths P1 to P11. The respective paths P are intermediate outflow paths in which the refrigerant flows out from the heat transfer tubes 15*b* of the intermediate tube row L2 when the heat exchanger 11A is being used as an evaporator. Furthermore, when the heat exchanger is being used as an evaporator, the refrigerant flows into the heat transfer tubes 15*a* of the upstream tube row L1 in each path P.

The paths P1 to P5 positioned in the upper portion are each constituted by three heat transfer tubes 15 and two U-shaped tube parts (1.5 round-trips). The paths P6 to P10 positioned in a central region in the up/down direction are each constituted by five heat transfer tubes 15 and four U-shaped tube parts (2.5 round-trips). The path P11 positioned in the lowermost portion is constituted by seven heat transfer tubes 15 and six U-shaped tube parts (3.5 round-trips). A path structure which has different lengths of the paths P depending on the position in this way is effective in cases where the speed of the air flowing in the air flow direction A differs depending on the position in the up/down direction, and similar beneficial effects to those of the second modification example are obtained.

Moreover, in the third modification example, it is envisaged that a drain pan (not illustrated) is arranged so as to surround the lower surface of the heat exchanger 11A and either side section of the path P11 in FIG. 8B. By arranging a drain pan at this position, the speed of the air flowing in the vicinity of the path P11 can more readily be slowed in comparison with the speed of the air flowing in the regions thereabove. Consequently, by making the flow path length of the path P11 which is affected by the drain pan longer than the other paths P, it is possible to promote heat exchange in path P11 and to optimize the flow ratio of refrigerant.

FOURTH MODIFICATION EXAMPLE

Figure 9:
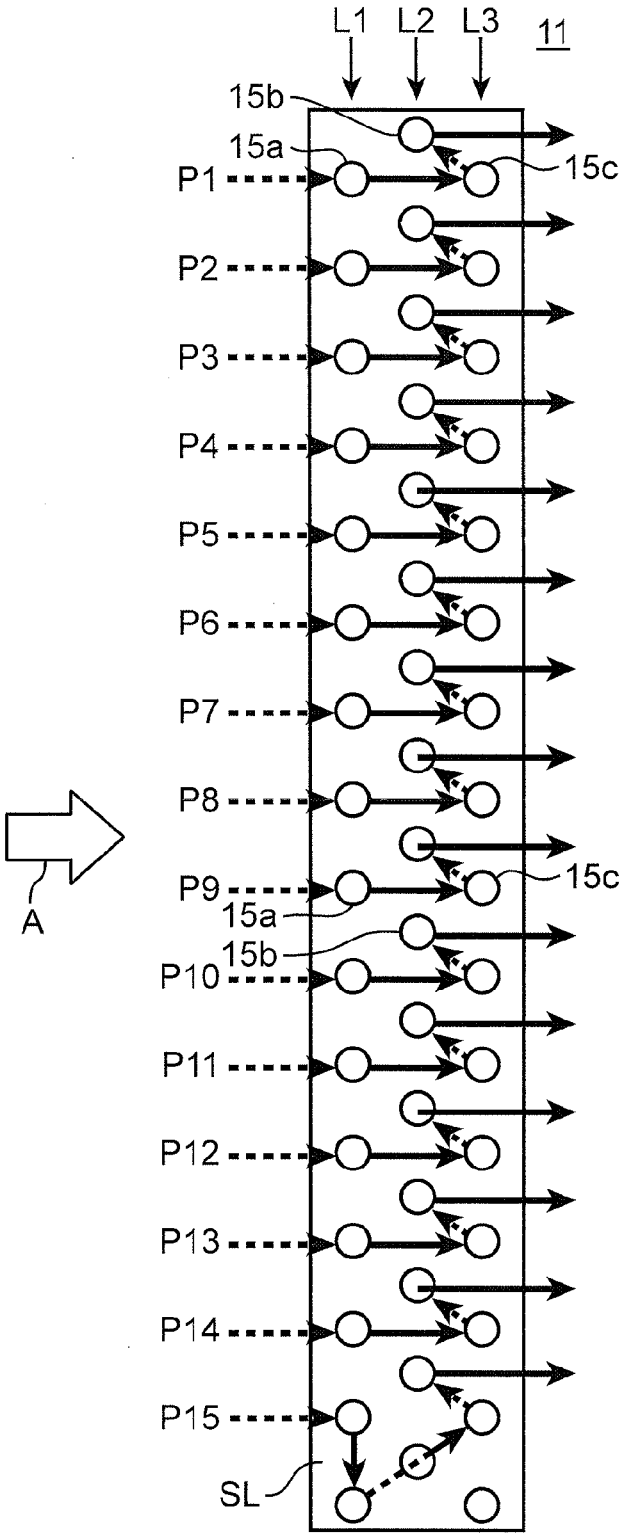
FIG. 9 is a left side diagram showing a fourth modification example of the heat exchanger for an air conditioner, depicting paths along which the refrigerant flows when the heat exchanger is used as an evaporator.

FIG. 9 is a left side diagram showing a fourth modification example of the heat exchanger 11A (11), depicting paths along which the refrigerant flows when the heat exchanger 11A is used as an evaporator.

In this fourth modification example, the heat exchanger 11A has fifteen paths P1 to P15. The respective paths P are intermediate outflow paths in which the refrigerant flows out from the heat transfer tubes 15*b* of the intermediate tube row L2, when the heat exchanger 11A is being used as an evaporator. Furthermore, when the heat exchanger is being used as an evaporator, the refrigerant flows into the heat transfer tubes 15*a* of the upstream tube row L1 in each path P.

The paths P1 to P14 are each constituted by three heat transfer tubes 15 and two U-shaped tube parts (1.5 round-trips). The path P15 positioned in the lowermost portion is constituted by five heat transfer tubes 15 and four U-shaped tube parts (2.5 round-trips). In this fourth modification example, similarly to the third modification example described above, by making the flow path length of the path P15 which is affected by the drain pan longer than the other paths P, it is possible to promote heat exchange in path P15 and to optimize the flow ratio of refrigerant.

FIFTH MODIFICATION EXAMPLE

Figure 10A:
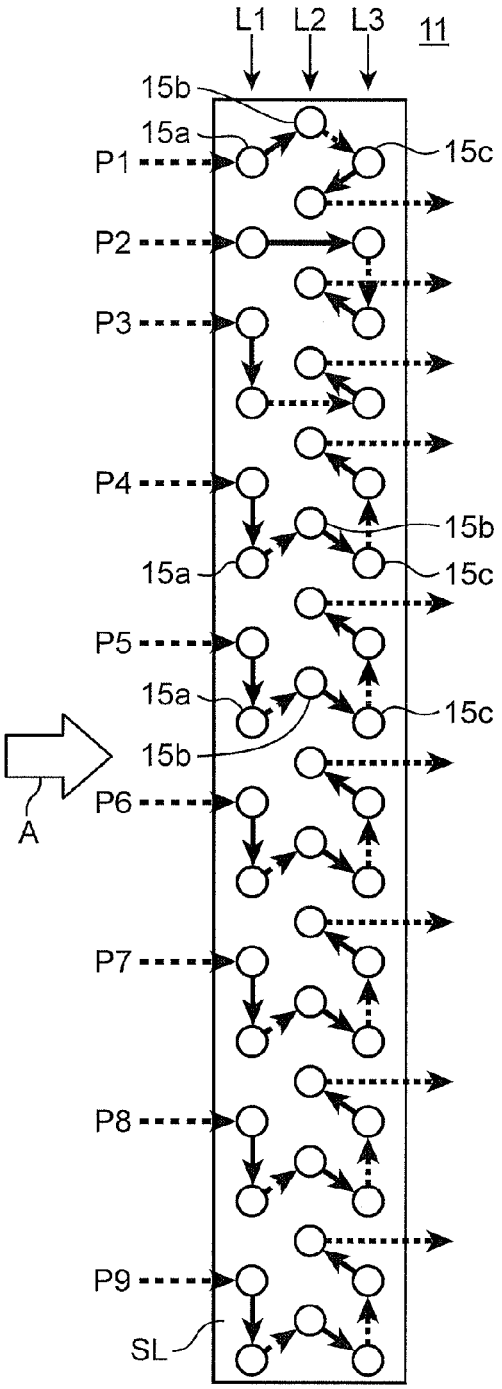
FIG. 10A is a left side diagram showing a fifth modification example of the heat exchanger for an air conditioner, depicting paths along which the refrigerant flows when the heat exchanger is used as an evaporator.

FIG. 10A is a left side diagram showing a fifth modification example of the heat exchanger 11A (11), depicting paths along which the refrigerant flows when the heat exchanger 11A is used as an evaporator.

In this fifth modification example, the heat exchanger 11A has nine paths P1 to P9. The respective paths P are intermediate outflow paths in which the refrigerant flows out from the heat transfer tubes 15*b* of the intermediate tube row L2 when the heat exchanger 11A is being used as an evaporator. Furthermore, when the heat exchanger is being used as an evaporator, the refrigerant flows into the heat transfer tubes 15*a* of the upstream tube row L1 in each path P. In this fifth modification example, the end portions of the heat transfer tubes 15*a* into which the refrigerant flows and the end portions of the heat transfer tubes 15*b* from which the refrigerant flows out are both positioned on the side of the right-side section SR.

The paths P1 to P3 positioned in the upper portion are each constituted by four heat transfer tubes 15 and three U-shaped tube parts (2 round-trips). The paths P4 to P9 positioned below these paths P are each constituted by six heat transfer tubes 15 and five U-shaped tube parts (3 round-trips). Similarly to the second modification example which was described above, a path structure which has different lengths of the paths P depending on the position in this way is effective in cases where the speed of the air flowing in the air flow direction A differs depending on the position in the up/down direction.

SIXTH MODIFICATION EXAMPLE

Figure 10B:
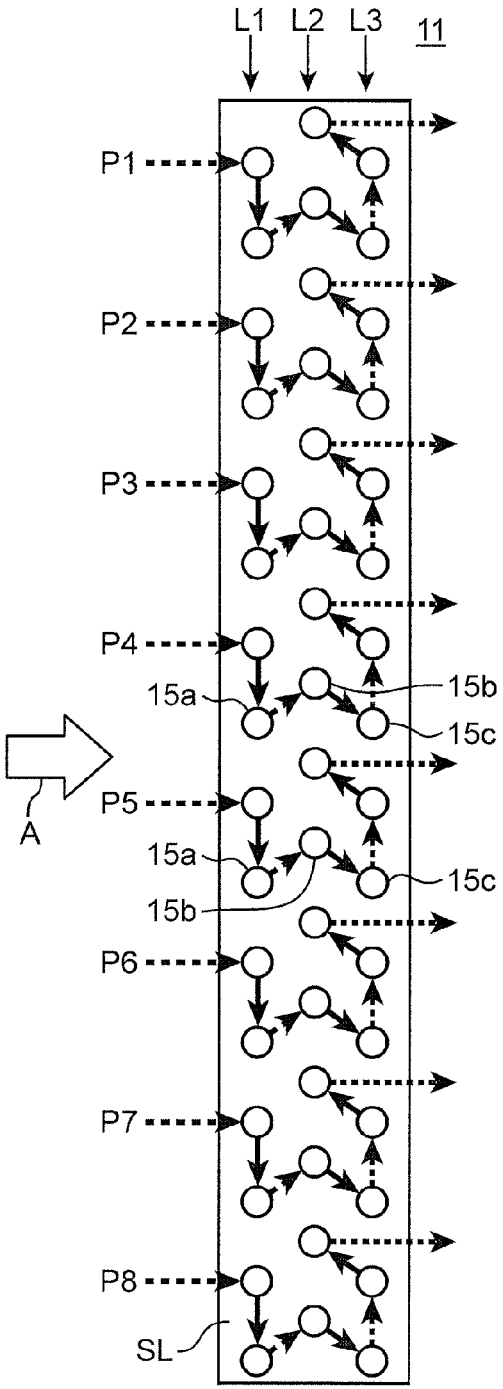
FIG. 10B is a left side diagram showing a sixth modification example of the heat exchanger for an air conditioner, depicting paths along which the refrigerant flows when the heat exchanger is used as an evaporator.

FIG. 10B is a left side diagram showing a sixth modification example of the heat exchanger 11A (11), depicting paths along which the refrigerant flows when the heat exchanger 11A is used as an evaporator.

In this sixth modification example, the heat exchanger 11A has eight paths P1 to P8. The respective paths P are intermediate outflow paths in which the refrigerant flows out from the heat transfer tubes 15*b* of the intermediate tube row L2 when the heat exchanger 11A is being used as an evaporator. Furthermore, when the heat exchanger is being used as an evaporator, the refrigerant flows into the heat transfer tubes 15*a* of the upstream tube row L1 in each path P. The paths are each constituted by six heat transfer tubes 15 and five U-shaped tube parts (3 round-trips).

As described above, in the present embodiment, among the plurality of paths P, there is at least one coexistent path P where a parallel flow portion R1 and a counter-flow portion R2 both exist, both when the heat exchanger is used as a condenser and when the heat exchanger is used as an evaporator, as shown in FIGS. 5A and 5B. In other words, the heat exchanger 11 according to the present embodiment includes at least one coexistent path in which a region forming orthogonal counter-flows (counter-flow region R2) and a region forming orthogonal parallel flows (parallel flow region R1) exist, both when the heat exchanger 11 is used as a condenser and when the heat exchanger 11 is used as an evaporator. Consequently, the balance between the heating performance and the cooling performance is improved, compared to a case where all of the paths are either orthogonal counter-flows or orthogonal parallel flows, as shown in FIGS. 11A and 11B.

In the coexistent path P according to the present embodiment, by adopting a structure in which the refrigerant flows out from the heat transfer tubes 15*a* of the upstream tube row L1 in terms of the air flow direction A, when the heat exchanger is used as a condenser, the refrigerant can be transformed more readily to a supercooled state in the condenser. Furthermore, by adopting a structure in which the refrigerant flows out from the heat transfer tubes 15*b* of the intermediate tube row L2, which are to the upstream side of the downstream tube row L3 in terms of the air flow direction A, when the heat exchanger is used as an evaporator, then the refrigerant can be transformed more readily to a superheated state in the evaporator, compared to a case where the refrigerant flows out from the heat transfer tubes 15*c* of the downstream tube row L3 on the furthest downstream side in terms of the air flow direction A.

Accordingly, in the present embodiment, it is possible to suppress decline in the evaporation performance, while emphasizing the condensing performance. Consequently, when the heat exchanger according to the present embodiment is used as an indoor heat exchanger, for instance, it is possible to suppress decline in the cooling performance while emphasizing the heating performance. Furthermore, when the heat exchanger according to the present embodiment is used as an outdoor heat exchanger, for instance, it is possible to suppress decline in the heating performance while emphasizing the cooling performance.

In the present embodiment, the plurality of paths P include a greater number of coexistent paths P than the number of downstream outflow paths P in which the refrigerant flows out from the heat transfer tubes 15*c* of the downstream tube row L3 when the heat exchanger is used as an evaporator. Therefore, it is possible further to enhance the beneficial effect of improving balance between the heating performance and the cooling performance.

The concrete embodiment described above principally includes an invention having the following structure.

(1) The heat exchanger for an air conditioner according to the present invention includes: a plurality of fins (13); and a plurality of heat transfer tubes (15) passing through the plurality of fins (13). The heat exchanger for an air conditioner has a row structure in which three or more rows of tube rows (L) of heat transfer tubes (15) are arranged along an air flow direction (A); the heat exchanger has a plurality of paths (P) which are refrigerant paths; the heat exchanger for an air conditioner is a cross-fin tube heat exchanger for an air conditioner capable of switching between heating operation and cooling operation; and at least one of the plurality of paths (P) is a coexistent path (P), in which both of a parallel flow portion (R1) where refrigerant flows from a heat transfer tube (15) of one of the tube rows (L) in the row structure to a heat transfer tube (15) of a tube row (L) on a downstream side of the one tube row (L) in terms of the air flow direction (A), and a counter-flow portion (R2) where refrigerant flows from a heat transfer tube (15) of one of the tube rows (L) in the row structure to a heat transfer tube (15) of a tube row (L) on an upstream side of the one tube row (L) in terms of the air flow direction (A), exist in use both as a condenser and as an evaporator.

In this structure, the plurality of paths (P) includes at least one coexistent path (P) in which a parallel flow portion (R1) and a counter-flow portion (R2) are both present, both when the heat exchanger is used as a condenser and when the heat exchanger is used as an evaporator. In other words, the heat exchanger having the present structure includes at least one coexistent path in which a region forming orthogonal counter-flows (counter-flow region (R2)) and a region forming orthogonal parallel flows (parallel flow region (R1)) exist, in use both as a condenser and as a condenser. Consequently, the balance between the heating performance and the cooling performance is improved, compared to a case where all of the paths are either orthogonal counter-flows or orthogonal parallel flows.

(2) In the heat exchanger for an air conditioner described above, desirably, in the coexistent path (P), in the use a condenser, the refrigerant flows out from the heat transfer tube (15) of the tube row (L) on the furthest upstream side in terms of the air flow direction (A); and in the use as an evaporator, the refrigerant flows out from the heat transfer tube (15) of a tube row (L) on the upstream side of the tube row (L) on the furthest downstream side in terms of the air flow direction (A).

In the coexistent path (P) according to the aspect, by adopting a structure in which the refrigerant flows out from the heat transfer tube (15) of the tube row (L) on the furthest upstream side in terms of the air flow direction (A), when the heat exchanger is used as a condenser, the refrigerant can be transformed more readily to a supercooled state in the condenser. Furthermore, by adopting a structure in which the refrigerant flows out from the heat transfer tubes (15) of the tube row (L) on the upstream side of the tube row (L) in the furthest downstream position in terms of the air flow direction (A), when the heat exchanger is used as an evaporator, the refrigerant can he transformed more readily to a superheated state in the evaporator, compared to when the refrigerant flows out from the heat transfer tubes (15) of the tube row (L) in the furthest downstream position in terms of the air flow direction (A).

Accordingly, in the aspect, it is possible to suppress decline in the evaporation performance, while emphasizing the condensing performance. Consequently, when this heat exchanger is used as an indoor heat exchanger, for instance, it is possible to suppress decline in the cooling performance while emphasizing the heating performance. Furthermore, when this heat exchanger is used as an outdoor heat exchanger, for instance, it is possible to suppress decline in the heating performance while emphasizing the cooling performance.

(3) The following structure is given as a specific example of the heat exchanger for an air conditioner. For example, the row structure has an upstream tube row (L1) which is positioned on the furthest upstream side in terms of the air flow direction (A), a downstream tube row (L3) which is positioned on the furthest downstream side in terms of the air flow direction (A), and an intermediate tube row (L2) which is positioned between the upstream tube row (L1) and the downstream tube row (L3); the coexistent path (P) has: a parallel flow portion (R1) where refrigerant flows from a heat transfer tube (15) of the intermediate tube row (L2) to a heat transfer tube (15) of the downstream tube row (L3) in the use as a condenser, and a counter-flow portion (R2) where refrigerant flows from the heat transfer tube (15) of the downstream tube row (L3) to the heat transfer tube (15) of the upstream tube row (L1) in the use as a condenser; and a parallel flow portion (R1) where refrigerant flows from the heat transfer tube (15) of the upstream tube row (L1) to the heat transfer tube (15) of the downstream tube row (L3) in the use as an evaporator, and a counter-flow portion (R2) where refrigerant flows from the heat transfer tube (15) of the downstream tube row (L3) to the heat transfer tube (15) of the intermediate tube row (L2) in the use as an evaporator, and in the use as an evaporator, the coexistent path (P) is an intermediate outflow path (P) in which refrigerant flows out from the heat transfer tube (15) of the intermediate tube row (L2).

(4) In the heat exchanger for an air conditioner described above, the plurality of paths (P) includes a greater number of the coexistence paths (P) than downstream outflow paths (P) in which refrigerant flows out from the heat transfer tubes (15*c*) of the downstream tube row (L3), when used as an evaporator.

In this structure, it is possible further to enhance the beneficial effect of improving balance between the heating performance and the cooling performance.

An embodiment of the present invention was described above, but the present invention is not limited to the embodiment given here and may be modified in various ways.

For example, in the embodiment described above, an example is described in which the refrigerant flows out from the heat transfer tubes 15*a* of the upstream tube row L1 when the heat exchanger is used as a condenser, and the refrigerant flows out from the heat transfer tubes 15*b* of the intermediate tube row L2 when the heat exchanger is used as an evaporator, but the invention is not limited to this. In the present invention, at least one path should be a coexistence path. In another mode, there is a path structure in which the refrigerant flows out from the heat transfer tubes 15*a* of the upstream tube row L1 when the heat exchanger is being used as a condenser, for instance, and the refrigerant flows out from the heat transfer tubes 15*a* of the upstream tube row L1 when the heat exchanger is being used as an evaporator. In yet a further mode, there is a path structure in which the refrigerant flows out from the heat transfer tubes 15*b* of the intermediate tube row L2 when the heat exchanger is being used as a condenser, for instance, and the refrigerant flows out from the heat transfer tubes 15*b* of the intermediate tube row L2 when the heat exchanger is being used as an evaporator. In yet a further mode, there is a path structure in which the refrigerant flows out from the heat transfer tubes 15*b* of the intermediate tube row L2 when the heat exchanger is being used as a condenser, for instance, and the refrigerant flows out from the heat transfer tubes 15*a* of the upstream tube row L1 when the heat exchanger is being used as an evaporator.

Furthermore, in the embodiment described above, a row structure having three tube rows L1 to L3 is described, but the invention is not limited to this. It is also possible to have a heat exchanger which has a row structure including four or more tube rows.

EXPLANATION OF REFERENCE NUMERALS

11 heat exchanger for air conditioner
11A indoor heat exchanger
11B outdoor heat exchanger
13 fin
15 heat transfer tube
17 U-shaped tube part
81 air conditioner
A air flow direction
P (P1 to P14) path
L tube row
L1 upstream tube row
L2 intermediate tube row
L3 downstream tube row
R1 parallel flow portion
R2 counter-flow portion

The invention claimed is:

1. A cross-fin tube heat exchanger for an air conditioner capable of switching between heating operation and cooling operation the cross-fin tube heat exchanger comprising:

a fin unit in which a plurality of fins are arranged in a thickness direction of each of the plurality of fins, and each of the plurality of fins is formed by one plate;

a plurality of heat transfer tubes passing through the plurality of fins; and a plurality of U-shaped tube parts, each of the plurality of U-shaped tube parts connecting two of the plurality of heat transfer tubes to each other, wherein the plurality of heat transfer tubes are arranged in three rows along an air flow direction;

the three rows of the plurality of heat transfer tubes includes an upstream tube row which is positioned on the furthest upstream side in terms of the air flow direction, a downstream tube row which is positioned on the furthest downstream side in terms of the air flow direction, and an intermediate tube row which is positioned between the upstream tube row and the downstream tube row, the plurality of U-shaped tube parts include a plurality of first U-shaped tube parts and a plurality of second U-shaped tube parts, each of the plurality of first U-shaped tubes parts fluidically connects one of the plurality of upstream heat transfer tubes and one of the plurality of downstream heat transfer tubes, each of the plurality of second U-shaped tube parts fluidically connects one of the plurality of intermediate heat transfer tubes and one of the plurality of downstream heat transfer tubes, a plurality of refrigerant paths;

each of the plurality of refrigerant paths is defined by one of the plurality of upstream heat transfer tubes, one of the plurality of intermediate heat transfer tubes, one of the plurality of downstream heat transfer tubes, one of the plurality of first U-shaped tube parts and one of the plurality of second U-shaped tube parts, each of the plurality of upstream heat transfer tubes is fluidically connected to a liquid pipe of the air conditioner, each of the plurality of intermediate heat transfer tubes is fluidically connected to a gas pipe of the air conditioner, the plurality of refrigerant paths are arranged such that the first and second U-shaped tube parts of one of the plurality of refrigerant paths does not overlap the first and second U-shaped tube parts of another of the plurality of refrigerant paths along the airflow direction.

* * * * *